US010351397B2

(12) United States Patent
Uebel

(10) Patent No.: US 10,351,397 B2
(45) Date of Patent: Jul. 16, 2019

(54) CHAIN HOIST

(71) Applicant: Heinrich de Fries GmbH, Düsseldorf (DE)

(72) Inventor: Klaus C. Uebel, Düsseldorf (DE)

(73) Assignee: Heinrich de Fries GmbH, Düsseldorf (DE)

( * ) Notice: Subject to any disclaimer, the term of this patent is extended or adjusted under 35 U.S.C. 154(b) by 0 days.

(21) Appl. No.: 15/960,585

(22) Filed: Apr. 24, 2018

(65) Prior Publication Data

US 2018/0305189 A1 Oct. 25, 2018

(30) Foreign Application Priority Data

Apr. 24, 2017 (DE) ..... 10 2017 108 694

(51) Int. Cl.

| | |
|---|---|
| ***B66D 3/14*** | (2006.01) |
| ***B66D 5/14*** | (2006.01) |
| ***B66D 5/34*** | (2006.01) |

(52) U.S. Cl.

CPC ..... *B66D 3/14* (2013.01); *B66D 5/14* (2013.01); *B66D 5/34* (2013.01)

(58) Field of Classification Search

CPC ... B66D 3/14; B66D 5/04; B66D 5/08; B66D 5/18; B66D 5/34

See application file for complete search history.

(56) References Cited

U.S. PATENT DOCUMENTS

| | | | | |
|---|---|---|---|---|
| 4,103,872 | A * | 8/1978 | Hirasuka | B66D 1/58 254/356 |
| 4,348,011 | A * | 9/1982 | Honda | B66D 1/58 192/223.1 |
| 4,502,667 | A | 3/1985 | Nakamura | |
| 4,512,555 | A * | 4/1985 | Nakamura | B66D 3/14 192/101 |
| 5,127,631 | A * | 7/1992 | Flaig | B66D 1/54 182/239 |
| 5,848,781 | A * | 12/1998 | Kulhavy | B66D 3/18 254/360 |
| 2010/0226748 | A1* | 9/2010 | Wolner | A62B 35/0093 414/815 |

FOREIGN PATENT DOCUMENTS

| | | |
|---|---|---|
| DE | 1 246 972 | 8/1967 |
| DE | 101 48 408 | 11/2002 |

* cited by examiner

*Primary Examiner* — Emmanuel M Marcelo
(74) *Attorney, Agent, or Firm* — Gudrun E. Huckett

(57) ABSTRACT

A chain hoist with a chain wheel and a load chain looped around the chain wheel has a shaft rotatably mounted in the housing for driving the chain wheel. A threaded disc with internal thread is connected to an external thread of the shaft and has a drive gear tooth system engaged by a force element actuated manually or motorized. A brake disc rotatable relative to shaft and threaded disc has a braking surface facing a drive surface of the shaft and a braking surface facing the threaded disc. The brake disc has locking teeth engaging a safety catch of the housing. A freewheel device is provided to increase an axial distance between threaded disc and drive surface. Centrifugal elements with outward friction surface are fixed to the threaded disc and expand outwardly against a spring force to contact a braking surface of the housing with their friction surface.

8 Claims, 3 Drawing Sheets

CHAIN HOIST

BACKGROUND OF THE INVENTION

The invention relates to a chain hoist for lifting, lowering and pulling loads, comprising:

a housing, in which a chain wheel, around which a load chain, provided at its end with a draw hook, is looped with form fit, and a shaft, which drives the chain wheel, preferably via a gear unit, are rotatably mounted;

a threaded disc, which, with its internal thread, is in screw connection with an external thread of the shaft, and is provided with a drive gear tooth system for engagement by a force element moved by manual or motorized means;

a brake disc, which is rotatable with respect to the shaft and the threaded disc, having a first braking surface, which is facing a drive surface rotationally fixed to the shaft, and a second braking surface, which is facing the threaded disk, and having locking teeth, arranged on the brake disc, for the unilaterally blocking engagement of a safety catch mounted at n the housing;

a freewheel device, which is configured to increase the axial distance between threaded disc and drive surface.

Components of such a chain hoist, as disclosed in a typical design in U.S. Pat. No. 4,512,555, are a housing provided with a hook as the abutment element, a drive shaft rotatably mounted in the housing, an actuating lever that can be coupled to the drive shaft, and a chain wheel, which can be set in rotation by the drive shaft and over which the load chain of the chain hoist, which load chain is provided with a hook, is guided. The actuating lever can be coupled to the drive shaft via a detent mechanism. In addition, chain hoists of this type usually have a freewheel device that, when switched on, decouples the drive shaft from the actuating lever or the detent mechanism.

Primarily, these chain hoists are used to lift or lower loads. For this purpose, in the case of a manually operated chain hoist, the actuating lever thereof is pivoted back and forth, wherein the chain wheel, just with the one movement, is successively further rotated by the integrated detent mechanism and in this way raises or lowers the load chain with the weight load hanging therefrom. Chain hoists of the generic type further possess a freewheel device which can be manually switched on. In the freewheel setting, the chain can be freely pulled through in one or the other direction. In addition, chain hoists of this type possess a self-acting load pressure brake. This is a mechanism which prevents the freewheel device from being switched on when a load is still hanging from the chain wheel and therefore a minimum torque is present at the drive shaft. The load pressure brake prevents the drive shaft, and hence the weight load, from being released by accidentally switching on the freewheel action.

The same chain hoists are frequently also used for other load tasks. One example is installation work on overhead power lines. When installing the power lines, they have to be tensioned first and then suspended from current insulators. Because of the particular localities, such work can only be performed by specialist technicians. In this context, there have been extreme situations, above all upon the occurrence of strong gusts of wind, in which, after the freewheel action had been switched on since no load was any longer present, tensile forces nevertheless arose in the load chain, possibly due to swaying of the chain hoist, associated with a pay-out of the chain. When this pay-out occurred with increasing speed, a violent flapping of the free chain ends (whip effect) occurred additionally, associated with a considerable risk of injury for the technician.

The object of the invention is to make a contribution to defusing dangerous, albeit only rarely occurring, extreme situations, as they arise primarily when the freewheel action is switched on, by means of technical measures on the chain hoist.

SUMMARY OF THE INVENTION

To this end, a chain hoist is proposed that is characterized in that at least one centrifugal element is arranged on the threaded disc and is rotationally fixed relative thereto, and which on the outside is provided with a friction surface, and in that the centrifugal element is expandable outwardly counter to the force of a spring to the point of contact of the friction surface at a braking surface configured on the housing.

Such a chain hoist is distinguished by an integrated, load-pressure-dependent and speed-dependent brake. In particular, the speed is limited at which the load chain, in the case of activated freewheel device, can pay out. Too fast a pay-out of the load chain is associated with the risk that its other, free end begins to flap about (whip effect) and, in so doing, endangers persons.

The freewheel device is configured to increase, by turning of the threaded disc on the external thread of the central shaft, the axial distance between the threaded disc and the drive surface arranged on the central shaft.

In regard to avoiding imbalances, it is advantageous when two or more centrifugal elements are present, which are arranged such that they are expandable outwardly away from one another.

When two or more centrifugal elements are used, it is advantageous that the spring is an annular spring which jointly encloses the centrifugal elements. This enables a simple construction with few individual parts and low imbalances during operation.

Preferably, the centrifugal elements are arranged in radially outwardly open recesses of the threaded disc. The centrifugal elements are supported in the peripheral direction against walls of the recesses in order to ensure the rotationally fixed arrangement of the centrifugal elements in relation to the threaded disc.

BRIEF DESCRIPTION OF THE DRAWINGS

Further advantages and details can be taken from the following description of an illustrative embodiment represented in the drawing.

DESCRIPTION OF PREFERRED EMBODIMENTS

Figure 1:
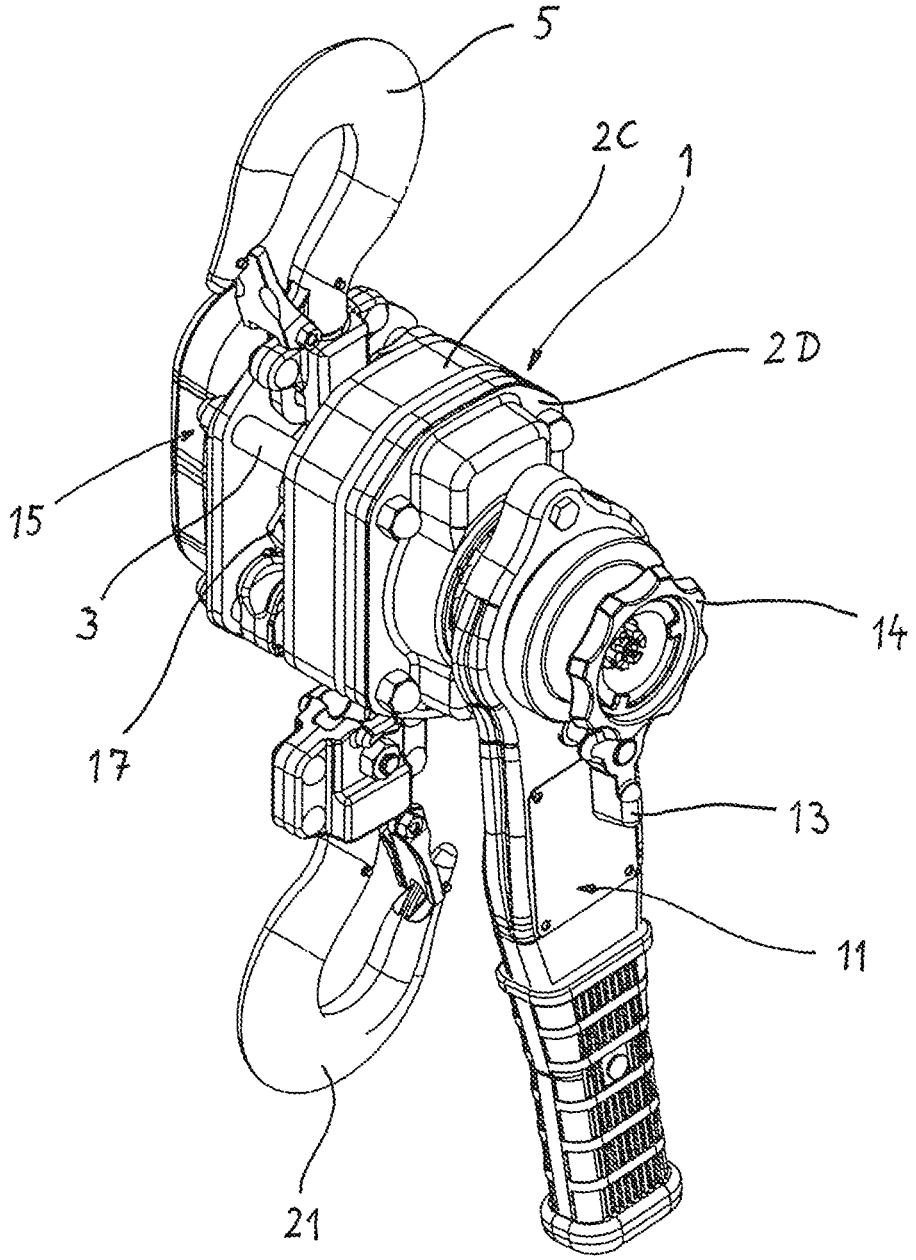
FIG. 1 shows in perspective representation a chain hoist in manually operated construction, with actuating lever, a multipart housing in which, inter alia, a detent mechanism, a reduction gear unit, a freewheel device with load pressure brake, and an additional safety device are arranged.
Figure 2:
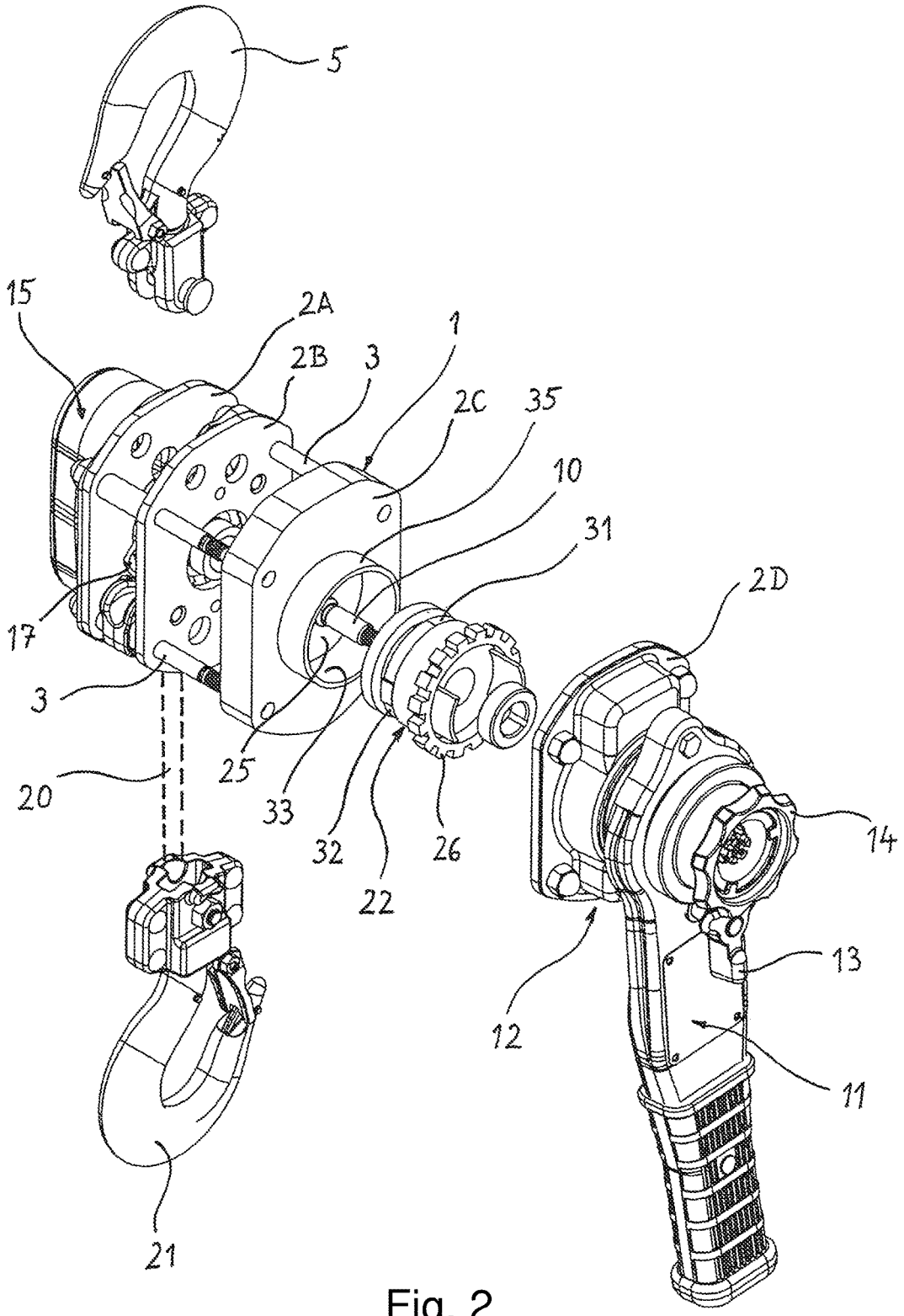
FIG. 2 shows individual components of the chain hoist in an exploded representation.

A component of the chain hoist is, inter alia, a housing 1, which is comprised of a plurality of housing plates 2A, 2B, 2C and 2D, as well as further housing parts. The housing plates 2A, 2B, 2C, 2D are connected to one another by bolts 3, which pass through openings close to the outer margins of the housing plates. The bolts 3 are arranged parallel to one another and guided transversely through the housing plates 2A, 2B, 2C, 2D, whereby the housing plates are drawn toward one another and are connected to intervening further housing parts to form in total a housing 1 which is closed toward the outside.

Between the two housing plates 2A and 2B, an abutment element, in the form of a hook 5 secured by a carabiner, is fastened such that the hook 5 is connected in a tension-resistant, yet pivotable manner to the housing 1.

A drive shaft 10 arranged on a center axis A passes through central openings in the housing plates 2A, 2B, 2C, 2D. The drive shaft 10 is rotatably mounted in at least some of the housing plates.

In order to rotate the drive shaft 10 for the operation of the chain hoist, at one end of the chain hoist an actuating lever 11 is present and provided at its free end with a rubberized handle. The actuating lever 11 can be coupled to the drive shaft 10 via gear elements, and partially also locking elements, in order to rotate the drive shaft 10 by pivoting the actuating lever. A detent mechanism comprised of two movable safety catches is configured in such a way that the actuating lever 11, when it is rotated in one peripheral direction, entrains the drive shaft 10 by means of a safety catch, and by contrast, when rotated in the opposite direction, decouples this safety catch, and another safety catch then locks instead.

A freewheel device 12 serves for rotary decoupling of the drive shaft 10 so that it can normally rotate freely. The freewheel device 12 is initially merely released via a switching lever 13 on the actuating lever 11, and then switched on via a selector knob 14 arranged coaxially on the shaft 10. For this purpose, the selector knob 14 is firstly pulled somewhat in the longitudinal direction of the shaft 10 and then turned, whereby the freewheel action is switched on.

At its other end, represented to the left in the drawing, the drive shaft 10 is provided with a pinion which is a component of a reduction gear unit 15. The reduction gear unit 15 is arranged in a gearbox casing and translates the rotation of the drive shaft 10 into a slower rotation of a gearbox output shaft. The gearbox output shaft is, in turn, rotationally fixed relative to a chain wheel 17. The chain wheel 17 is located between the housing plates 2A and 2B and preferably rotates coaxially to the shaft 10, yet at different rotation speed. To this end, the chain wheel 17 can be mounted, via an anti-friction mounting, on the drive shaft 10 passing centrally through the chain wheel 17.

The chain wheel 17 is provided with shaped recesses, distributed evenly over its periphery, for the individual chain links of a load chain 20 configured as a link chain. At one end, the load chain 20 is provided with a draw hook 21 which can be secured with a carabiner. A locking block, which prevents a full release of the load chain 20 from the chain wheel 17, can be fastened to the other end of the load chain 20, which is represented only schematically in the drawing.

A threaded disc 22 is arranged around the shaft 10. The threaded disc 22 is provided with an internal thread which is screwed onto an external thread 23 of the shaft 10. This screw connection is preferably a multiple-thread screw connection with relatively large thread pitch, whereby the threaded disc 22 can be screwed relatively easily in relation to the shaft 10.

On its outer periphery, the threaded disc 22 is provided with teeth of a drive gear tooth system 26. A switchable safety catch 27 configured on the switching lever 13 can engage the drive gear tooth system 26. The switching gear lever 13 is arranged on the manual actuating lever 11. Here, the actuating lever 11 is therefore the actual force-applying element. By appropriate switchover of the lever 13, the safety catch 27 is connected either in one direction of rotation or in the other direction of rotation to the drive gear tooth system 26, or the locking teeth of the safety catch 27 are totally disengaged from the drive gear tooth system 26 in the freewheel setting of the freewheel device 12.

The threaded disc 22 is, moreover, a component of a brake which serves, above all, as a load pressure brake. A further component of the brake is a brake disc 25, which is arranged axially between a driving surface 22A, configured on the threaded disc 22, and a drive surface 10A. The brake disc 25 has a first braking surface, which is facing the drive surface 10A, and a second braking surface on the other side, which is facing the driving surface 22A of the rotary threaded disk 22.

Figure 3:
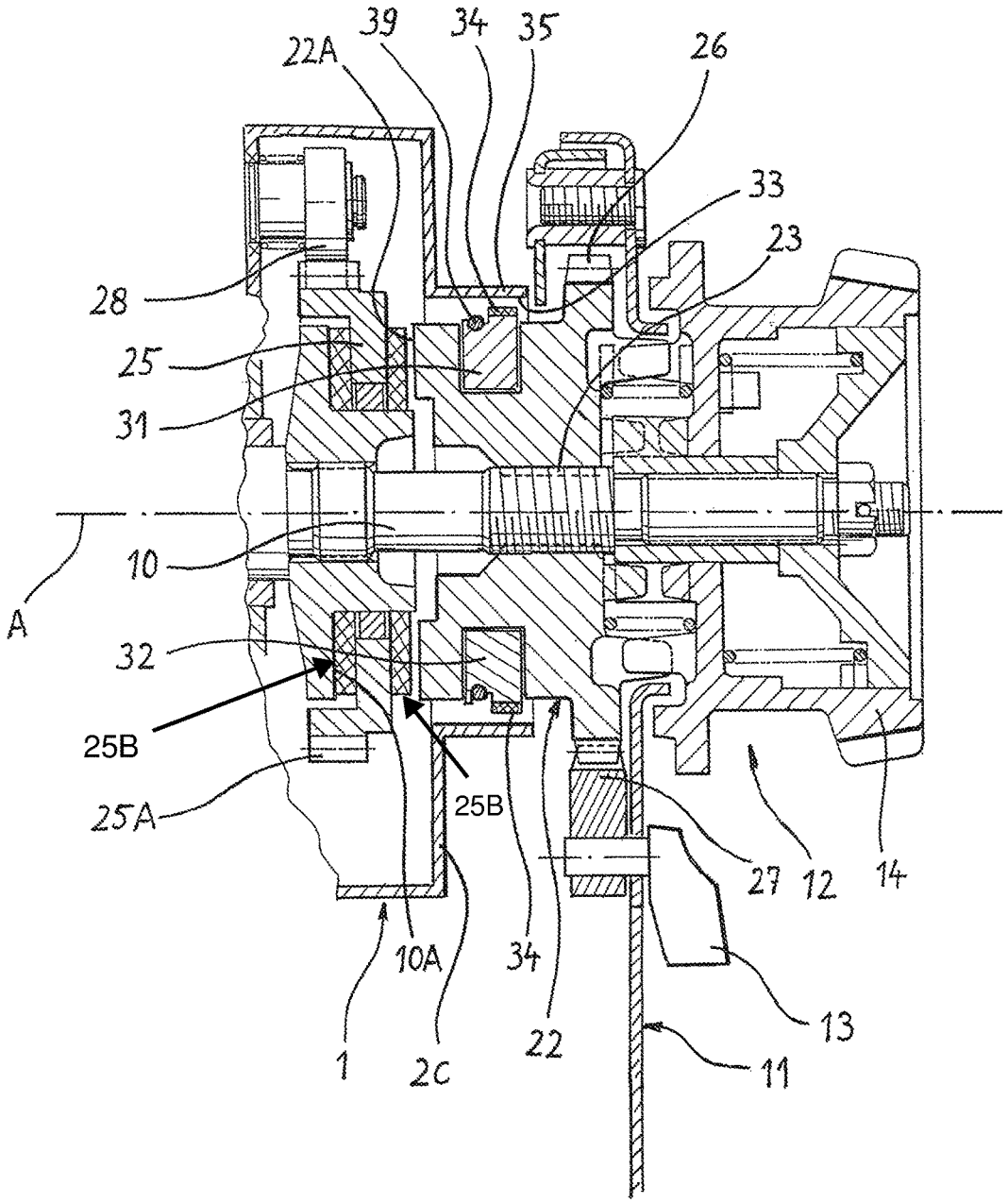
FIG. 3 shows a partial longitudinal section in the plane of the drive shaft of the chain hoist.

The drive surface 10A is either a component of the shaft 10, or is rotationally fixed relative to the shaft 10 in a suitable manner. Additionally, friction discs 25B which improve the braking effect can further be arranged at both sides of the brake disc 25, as shown in FIG. 3.

The brake disc 25 is provided with locking teeth 25A distributed about the periphery of the brake disc 25. The locking teeth 25A are configured for a unilaterally blocking engagement of a safety catch 28 mounted at the housing 1. Instead of one safety catch 28, two such safety catches 28 can also be present.

The chain hoist comprises a freewheel device 12 with self-acting load pressure brake. Both are described in detail, for example, in U.S. Pat. No. 4,512,555, to which reference is being had in this respect.

Independently of the actuation of the selector knob 14 of the freewheel device 12, the load pressure brake prevents the actual freewheeling of the shaft 10 when and for as long as a minimum load remains hanging from the chain wheel 17 and, therefore, a corresponding torque is present at the central shaft 10. The load pressure brake therefore operates as long as a specific minimum torque still acts on the shaft 10 and, in this way, prevents that the central shaft 10 and hence the weight load hanging from the draw hook 21 are released when the freewheel action is accidental switched on.

In addition to the load pressure brake, the chain hoist comprises a further safety device. The latter is comprised of two centrifugal elements 31, 32 arranged on the threaded disc 22 and rotating at the rotation speed of the threaded disc 22. The centrifugal elements 31, 32 are configured to move counter to a spring force to the point of contacting a braking surface 33 coaxially surrounding the threaded disc 22. This braking surface 33 is configured on the inside of the housing 1.

In particular, the braking surface 33 is located on the cylindrical inner wall of a housing ring 35, which is embodied together with the housing plate 2C as one piece and has a smaller diameter than the rest of the housing plate 2C.

For avoiding imbalances, the safety device operates with, in total, two radially mutually expanding centrifugal elements 31, 32, which respectively extend over somewhat less than half the periphery of the threaded disc 22. The centrifugal elements 31, 32 are mounted in radially outwardly open recesses of the threaded disc 22.

Although the two centrifugal elements 31, 32 are movable outwardly in accordance with the magnitude of the centrifugal forces, they are supported in the peripheral direction by means of corresponding rigid stops and are therefore rotationally fixed in relation to the threaded disc 22.

The centrifugal elements 31, 32 are connected to each other by an annular spring 39 which is laid around them. The strength of this spring 39 determines the rotation speed at which the centrifugal elements, at high rotation speeds of more than 250 rpm, and preferably more than 400 rpm, begin to butt against the cylindrical braking surface 33 at the housing, whereby the threaded disc 22 is thus braked.

In the case of a very fast rotation of drive shaft 10 and threaded disc 22, which is faster than the rotation associated with the fast, manual pull-through of the load chain 20 when the freewheel action is switched on, the centrifugal elements 31, 32 shift outwardly counter to the force of the spring 39. When the rotation speed at which the shaft and the threaded disc jointly rotate is sufficiently high so that the centrifugal elements 31, 32 contact, with friction surfaces 34 outwardly arranged thereon, the braking surface 33, a strong friction between the friction surfaces 34 and the housing 1 immediately ensues, resulting in a sudden braking of the threaded disc 22. This occurs at a rotation speed of the threaded disc 22 of more than 250 rpm, and preferably of more than 400 rpm.

However, the shaft 10 rotating with strong torque and at high rotation speed about the axis A, due to its own inertia and the inertia of the masses rotating jointly with the shaft 10, is not capable of following the sudden braking of the threaded disc 22. In a very short time, namely in fractions of a second, a relative rotation between the—still—rotating shaft 10 and the abruptly stopped threaded disc 22 therefore results. As a result, the helical, still rotating external thread 23 draws the threaded disc 22 in the direction of the brake disc 25 in a very short time. The brake engages, as if the load pressure brake were suddenly activated.

The advantage of the here described chain hoist resides in that a load-pressure-dependent and speed-dependent brake is created. The speed at which the load chain 20, even in the case of activated freewheel device, can pay out is limited. Above all, a load chain 20 that is moving faster and faster—associated with the danger that the other end thereof begins to flap about (whip effect) and, in so doing, thus endangers persons close by—is prevented.

The specification incorporates by reference the entire disclosure of German priority document 10 2017 108 694.3 having a filing date of Apr. 24, 2017, of which the instant application claims priority.

While specific embodiments of the invention have been shown and described in detail to illustrate the inventive principles, it will be understood that the invention may be embodied otherwise without departing from such principles.

LIST OF REFERENCE CHARACTERS

1 housing
2A housing plate
2B housing plate
2C housing plate
2D housing plate
3 bolt
5 abutment element, hook
10 shaft, drive shaft
10A drive surface
11 actuating lever
12 freewheel device
13 switching lever
14 selector knob
15 gear unit
17 chain wheel
20 load chain
21 draw hook
22 threaded disc
22A driving surface
23 external thread
25 brake disc
25A locking teeth; 25B friction disc
26 drive gear tooth system
27 safety catch
28 safety catch
31 centrifugal element
32 centrifugal element
33 braking surface
34 friction surface
35 housing ring
39 spring
A center axis

What is claimed is:

1. A chain hoist for lifting, lowering, and pulling a load, the chain hoist comprising:

a housing comprising a braking surface and a safety catch;

a chain wheel rotatably arranged in the housing;

a load chain looped around the chain wheel and comprising a draw hook connected to one end of the load chain, the load chain engaging with form fit the chain wheel;

a shaft rotatably mounted in the housing and operatively connected to the chain wheel for driving the chain wheel;

a threaded disc comprising an internal thread and connected with the internal thread to an external thread of the shaft, wherein the threaded disc comprises a drive gear tooth system;

a force element configured to be actuated manually or motorized, wherein the force element engages the drive gear tooth system;

a brake disc rotatable relative to the shaft and the threaded disc, the brake disc comprising a first braking surface facing a drive surface rotationally fixed relative to the shaft and comprising a second braking surface facing the threaded disc, the brake disc comprising locking teeth configured to engage with a unilateral blocking action the safety catch of the housing;

a freewheel device configured to increase an axial distance between the threaded disc and the drive surface;

at least one centrifugal element rotationally fixed at the threaded disc, wherein the at least one centrifugal element comprises an outwardly facing friction surface;

a spring arranged at the at least one centrifugal element, wherein the at least one centrifugal element is configured to expand outwardly counter to a force of the spring to contact the braking surface of the housing with the friction surface.

2. The chain hoist according to claim 1, further comprising a gear unit operatively connecting the drive shaft to the chain wheel.

3. The chain hoist according to claim 1, wherein the freewheel device is configured to increase the axial distance between the threaded disc and the drive surface by turning the threaded disc on the external thread of the shaft.

4. The chain hoist according to claim 1, wherein the braking surface of the housing is cylindrical.

5. The chain hoist according to claim 1, wherein, in total, two of said at least one centrifugal element are arranged on the threaded disc so as to be expandable outwardly away from one another.

6. The chain hoist according to claim 5, wherein the spring is an annular spring jointly enclosing said two centrifugal elements.

7. The chain hoist according to claim 5, wherein the threaded disc comprises radially outwardly open recesses and wherein said two centrifugal elements are arranged in the radially outwardly open recesses.

8. The chain hoist according to claim 7, wherein said two centrifugal elements are supported in a peripheral direction of the threaded disc against walls of the radially outwardly open recesses.

* * * * *